US008146190B1

(12) United States Patent
Wolfe

(10) Patent No.: US 8,146,190 B1
(45) Date of Patent: Apr. 3, 2012

(54) ADJUSTABLE BED SUPPORT

(76) Inventor: James Wolfe, Rogers, AR (US)

( * ) Notice: Subject to any disclaimer, the term of this patent is extended or adjusted under 35 U.S.C. 154(b) by 0 days.

(21) Appl. No.: 12/925,272

(22) Filed: Oct. 18, 2010

(51) Int. Cl.
*A47C 31/00* (2006.01)
*A47C 21/02* (2006.01)

(52) U.S. Cl. ..... 5/634; 5/633; 5/53.2

(58) Field of Classification Search ..... 5/633, 634, 5/53.1, 53.2, 661, 280
See application file for complete search history.

(56) References Cited

U.S. PATENT DOCUMENTS 508,382 A * 11/1893 Goodliffe ..... 5/634
1,156,125 A 10/1915 Ahlborn
2,663,880 A 12/1953 Meeks
3,287,746 A 11/1966 Weddle
3,482,271 A 12/1969 Enright
3,790,973 A 2/1974 Bradley ..... 5/53 B
3,981,031 A 9/1976 Schacht ..... 5/327
4,559,658 A * 12/1985 Cory et al. ..... 5/634
4,628,552 A 12/1986 Magistretti ..... 5/52
4,646,372 A 3/1987 Hanson ..... 5/433
4,651,365 A 3/1987 Zeigler ..... 5/74
4,754,507 A 7/1988 Edge ..... 5/72
5,036,556 A * 8/1991 Wieland ..... 5/53.1
5,353,450 A * 10/1994 Katan ..... 5/53.2
5,396,674 A 3/1995 Bolds ..... 5/633
5,425,150 A 6/1995 Palmer, Jr. et al. ..... 5/615
5,652,982 A 8/1997 Kiefer et al. ..... 5/634
5,695,251 A * 12/1997 Scolari ..... 297/408
6,151,738 A * 11/2000 Arr ..... 5/661
6,374,440 B1 4/2002 Thim, Jr. ..... 5/633

* cited by examiner

*Primary Examiner* — Michael Trettel
(74) *Attorney, Agent, or Firm* — Keisling & Pieper PLC; Meredith K. Lowry

(57) ABSTRACT

An improved inclined support for a bed is provided having an adjustable ramp secured to a frame configured to fit between the bed frame and the mattress.

20 Claims, 8 Drawing Sheets

ADJUSTABLE BED SUPPORT

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to bed attachments and accessories. In particular, the present invention relates specifically to an inclined bed support or bedrest.

2. Description of the Known Art

Many devices have been described for supporting a person while in bed. In general, past inventions taught both portable headrests and mechanical bed attachments wherein a tiltable panel is incorporated into a headboard. In the latter devices, the headboard is formed as an integral part of the bedstead or is otherwise permanently fastened to the bed frame. These known bed attachments, such as shown in U.S. Pat. Nos. 3,287,746 and 3,482,271, require custom installation and are intended to remain permanently affixed to the bed. Furthermore, such headboard attachments are rather expensive in comparison to the portable bedrest of this invention. A further disadvantage of these tiltable headboards is that they frequently are aesthetically unpleasing and further may not always be in harmony with the other room furniture or decor. Other bed supports which are not attached to the bed frame can shift or lack same amount of support provided by the attached bedrests. Therefore, there is a need in the art to provide a stowable bed support to maintain the décor of the bedroom and which remains detached from the frame of the bed while still maintaining the same level of support The present invention, in contrast, does not require any special installation, is portable and can be removed from the bed or secured without any tools or particular mechanical dexterity. Furthermore, the bed support of this invention is retractable and can be hidden from view behind the mattress when not being used.

Other portable bed accessories for providing a head or back rest include the portable prop structures that are not attached to the bed but rather are positioned in place on the mattress or against the headboard in order to support a person. Typical of such devices are cushion bed rests and polyurethane foam wedges. Another such portable device having a collapsible frame structure is shown in U.S. Pat. No. 2,663,880. An attachable frame rest is also described in U.S. Pat. No. 1,156,125. Pillows and other such flexible support devices offer little to no adjustability, effectively conforming to the user rather than supporting the user.

Some of the bed supports taught in the art allow for a user to customize the height of the support. The majority of these supports teach a mechanism under the mattress that allows for the mattress to be inclined at different angles. This type of mechanism is limited in its teachings as the mechanisms only allow for a predetermined length of the support. Thus, there is a need for a support that can be customized to adjust in height and in length.

Details of a other bed supports are contained in include U.S. Pat. No. 3,981,031, issued to Schacht et al. on Sep. 21, 1976; U.S. Pat. No. 4,651,365, issued to Zeigler on Mar. 24, 1987; U.S. Pat. No. 5,396,674, issued to Bolds on Mar. 14, 1995; U.S. Pat. No. 6,374,440, issued to Thim on Apr. 23, 2002; U.S. Pat. No. 5,652,982, issued to Kiefer et al. on Aug. 5, 1997; U.S. Pat. No. 3,790,973, issued to Bradley on Feb. 12, 1974; U.S. Pat. No. 4,628,552, issued to Magistreti on Dec. 16, 1986; U.S. Pat. No. 4,646,372, issued to Hanson on Mar. 3, 1987; U.S. Pat. No. 4,754,507, issued to Edge on Jul. 5, 1988; and U.S. Pat. No. 5,425,150 issued to Palmer on Jun. 20, 1995. Each of these patents is hereby expressly incorporated by reference in their entirety.

U.S. Pat. No. 3,981,031 issued to Schacht on Sep. 21, 1976, entitled Inclined Bedrest describes an improved portable inclined bedrest is secured to a bed by the weight of the mattress. A tubular steel frame is vertically extendible from within a storage housing and can be locked in position at selected heights above the mattress by the rotatable movement of a pair of swing arms mounted on the frame. A slant sheet for propping a pillow is affixed along an upper edge to the frame. The lower edge of the slant sheet is releasably fastened to the swing arms. The return movement of the swing arms to the initial position releases the frame for retraction into the storage housing.

U.S. Pat. No. 4,651,365 issued to Zeigler on Mar. 24, 1987 entitled Portable Adjustable Bed Raiser describes a portable bed raiser placed under one end of a mattress for adjustably raising and lowering that end of the mattress. The apparatus provides a lightweight, economical alternative to a complex, expensive hospital-type bed. This apparatus is easily compatible with standard beds and can be set up and removed at the convenience of the user.

U.S. Pat. No. 5,396,674 issued to Bolds on Mar. 14, 1995 entitled Inclined Body Support describes an inclined body support which includes a frame having a pair of triangular end braces joined-together by stays extending between corresponding corners of the end braces. A releasable coupling arrangement permits the frame to be varied slightly in size and disassembled for storage. A transverse connector joining the lowermost pair of stays near their respective midpoints reinforces the frame. Each of the stays further includes a pair of arms joined by a hinge for relative movement thus permitting the frame to conform to nonplanar supporting surfaces. A padded tent is suspended from the stays for retaining the upper body of a user at an inclination. For additional user comfort, the frame is covered with close-fitting foam pads.

U.S. Pat. No. 6,374,440 issued to Thim, Jr on Apr. 23, 2002 entitled Back Support describes a back support which provides a generally vertical and rigid panel removably installable along one edge of a bed, against which a person may brace his or her back or other body part as desired while reclining on the bed. The support comprises a frame with two opposed legs extending therefrom, with the legs each having a ninety degree bend therein. The legs may thus be inserted horizontally between the mattress and box spring or frame of a bed, with the frame being held generally vertically at the edge of the bed. The legs also telescope within the ends of the frame for height adjustment, and pivot to lie coplanar with the frame for carriage and storage of the device. The frame includes a rigid panel thereacross, with the panel having a cushion removably secured thereto and facing the center of the bed when the support is installed on the bed. The cushion includes a series of pockets on the outer surface thereof, for the removable insertion of therapeutic articles (e.g., hot and cold packs, etc.) therein. The frame may include additional structure to provide sufficient thickness for one or more storage compartments therein, if desired, for the storage of hot and cold packs, liniments, etc., as desired. The device is easily carried by a handle which is secured about the two adjacent folded legs to secure them together when the device is not in use. A cover may be provided for storage or for additional padding as desired.

U.S. Pat. No. 5,652,982 issued to Kiefer, et al. on Aug. 5, 1997 entitled Wall Hammock for use in the Sitting Position describes a wall hammock which includes a frame and a hammock. The frame is mounted on a wall above a bed or any other desired location. A first end of the hammock is removably attached to the frame. The second end of the hammock rests on the floor, on a bed, or on any substantially horizontal surface. The second end of the hammock is held in position by the lower torso of the user. The frame can also include a shelf. When the hammock is not in use, it can be easily rolled up and stored on the shelf. A cover can be positioned over the frame to keep the hammock out of sight when not in use.

U.S. Pat. No. 3,790,973 issued to Bradley on Feb. 12, 1974 entitled Adjustable Pivotal Headboard discloses a headboard for use with beds consisting of a supporting means mountable on a rigid medium, such as a bed frame, or a wall, or other suitable anchoring means, to permit tilting of the headboard and anchoring same at the desired position, with the headboard pivoting at one end and the other end traveling on a plane substantially parallel with the horizontal plane of the bed, the bar pivotally anchoring the headboard also acting as a stabilizing means, and the anchoring means being of novel structure to permit positive maintenance of the headboard at the desired position and novel means being provided to adjust the supporting means vertically.

U.S. Pat. No. 4,628,552 issued to Magistretti on Dec. 16, 1986 entitled Adjustable Back And Arm Structure For Bed Heads, Sofas and the Like describe an adjustable back and arm structure for beds, sofas and the like where it is possible to have a vertical arrangement, adapted for the use as a bed, of elements which can be lowered and inclined to form backrests and armrests or shelves. This structure can be realized so as to obtain lowering with a single movement or by independently actuating elements having backrest and armrest or shelf functions.

U.S. Pat. No. 4,646,372 issued to Hanson on Mar. 3, 1987 entitled Articulated Head Board Assembly discloses a headboard frame support recessed in a cavity of the frame and moveable upwardly out of the cavity. Constant tension spring mechanisms counterbalance each headrest assembly. Each headrest assembly includes a moveable standard slideable in the frame and a headrest pivotable carried on the standard. A latch locks the standard at prescribed heights.

U.S. Pat. No. 4,759,507 issued to Edge on Jul. 5, 1988 entitled Back Rest Device describing a back rest device comprising a frame means, a back rest, and connecting means for pivotally connecting the back rest to the frame means such that the back rest is pivotable in use of the back rest device between a substantially vertical position and an inclined position, and the connecting means also being such that the back rest is movable up and/or down as it is pivoting between the substantially vertical position and the inclined position whereby the back rest is able to rise over any obstacles that may be in the way.

U.S. Pat. No. 5,425,150 issued to Palmer on Jun. 20, 1995 entitled Articulating Device for a Flat Bed describes a device for converting a flat bed into an adjustable bed. The system has a base which mounts on the bed's box-springs and an articulating platform sandwiched between the box-springs and the mattress head section. The articulating platform pivots about the pivoting end of base by inflating bellows. The controls provide for adjustable firmness, degree and speed of pivoting, and delay for the start of the deflating of bellows for lowering articulating platform.

These prior art patents are very limited in their teaching and utilization, and an improved bed support is needed to overcome these limitations.

SUMMARY OF THE INVENTION

The nature of this invention concerns an improved portable inclined bed support that is removably secured between the mattress and the bedframe or wall. The bed support, or alternatively bedrest, includes an exterior frame to provide support and house the components of the support, an interior lift assembly which is vertically extendible from within the exterior frame, and an adjustable ramp which extends from the lift assembly. The exterior frame is configured to be inserted between the mattress and the wall or bedframe, securing the bed support to the bed by the frictional engagement of the mattress and frame or wall along with the weight of the adjustable ramp. When the adjustable ramp is retracted within the exterior frame, the bed support is substantially concealed from view.

The ramp and the lift assembly are configured to be slidably lifted vertically from the interior of the frame. The lift assembly is locked at a selected vertical height and the ramp is then positioned with a portion of the ramp resting on the top of the lift assembly and a portion of the ramp extending at an angle from the lift assembly along the top of the mattress, thereby providing support at different incline angles. A sheet, blanket, cushion or other flexible material can be positioned on top of the ramp to soften the ramp. The lift assembly has locking pins which engage the exterior frame to maintain the vertical height of the lift assembly. The locking pins can be released as desired without affecting the exterior frame.

It is a purpose of this invention to provide an improved inclined bed support for supporting a person in an inclined position to facilitate reading, eating, watching television, etc., while in bed. The device can also be used to comfortably raise the head, shoulders and back of a sick, convalescent, or invalid patient. A feature of this invention is that the adjustable ramp can be repositioned without the need for getting out of bed or retracting the frame assembly. Another advantage is that the exterior frame with the retracted lift assembly and ramp are concealed when the bed is made.

Specifically, it is an object of this invention to provide a portable bedrest which can be easily attached to a bed and held in place without the use of tools or fasteners.

A further object of this invention is to provide an inclined bedrest which can be concealed from view when the bed is made.

Another object of this invention is to provide an inclined bedrest having a lift assembly which can be raised to selective vertical heights above the mattress, thus providing support at different incline angles.

Another object of this invention is to provide an inclined bedrest having a lift assembly which can be raised to selective lengths along the mattress, thus providing support at different positions along the length of the body.

Still another object of this invention is to provide an inclined bedrest having an adjustable ramp for supporting a pillow wherein the ramp can be retracted and the pillow allowed to lie flat without lowering the lift assembly.

The above and other objects, features and advantages of this invention will be apparent in the following description of the preferred embodiment when considered in connection with the accompanying drawings. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
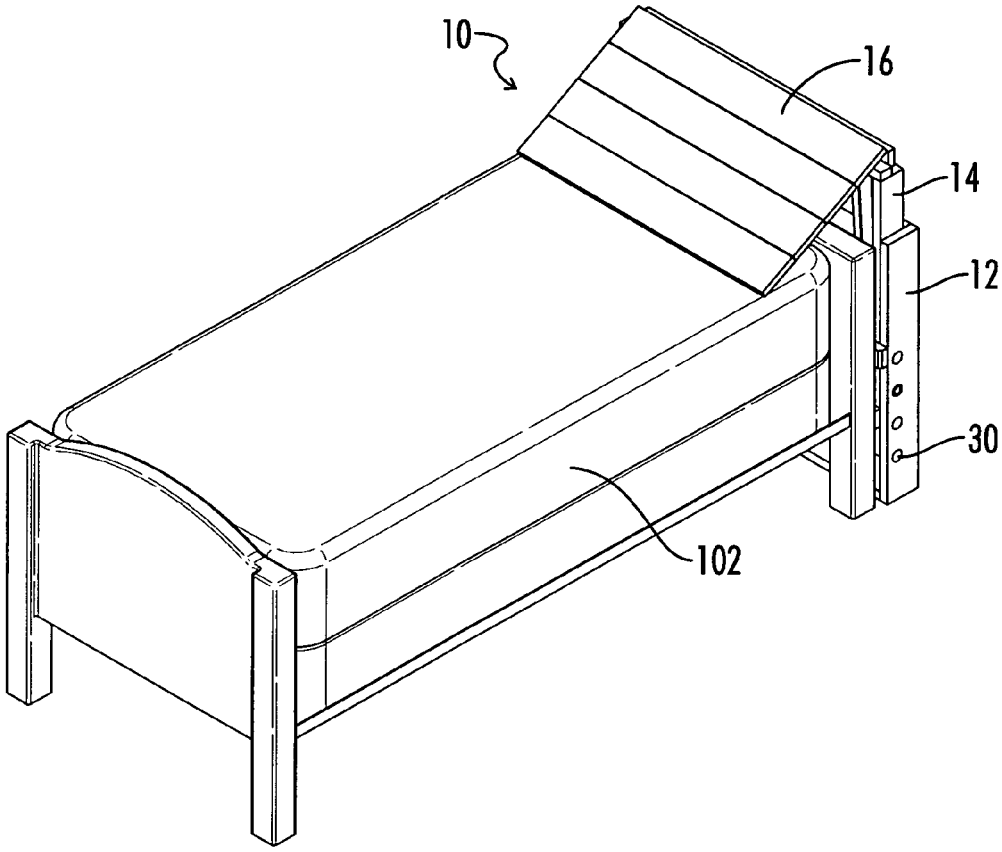
FIG. 1 is a perspective view of the present invention.
Figure 2:
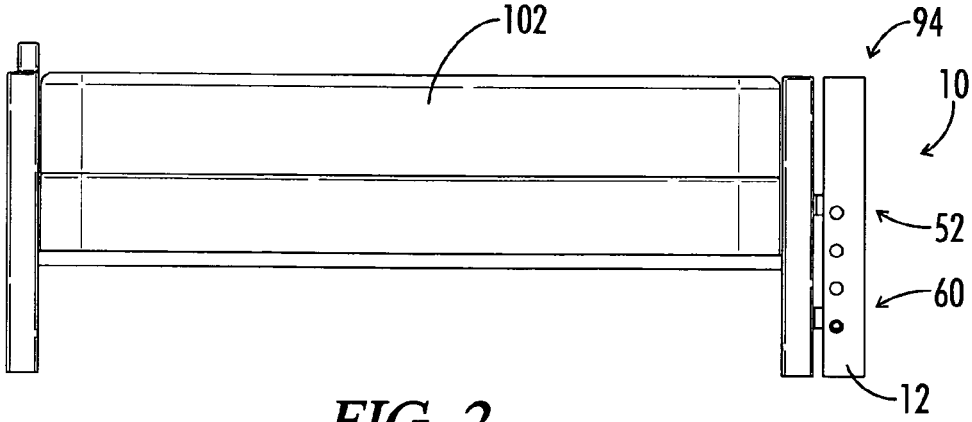
FIG. 2 is a right side elevational view of the present invention in its undeployed state.
Figure 3:
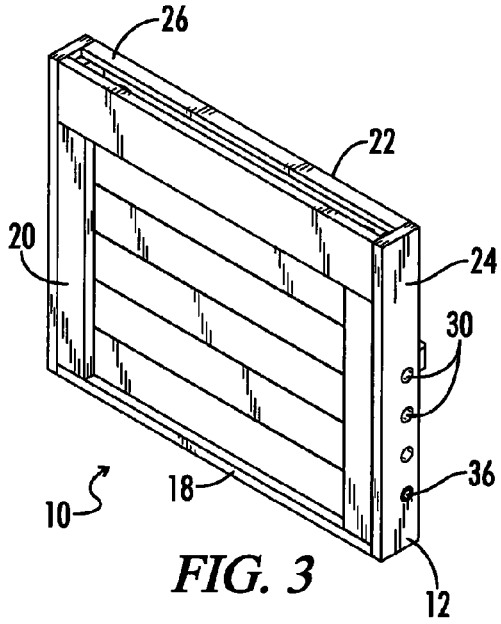
FIG. 3 is a perspective view of the present invention in its undeployed state.
Figure 4:
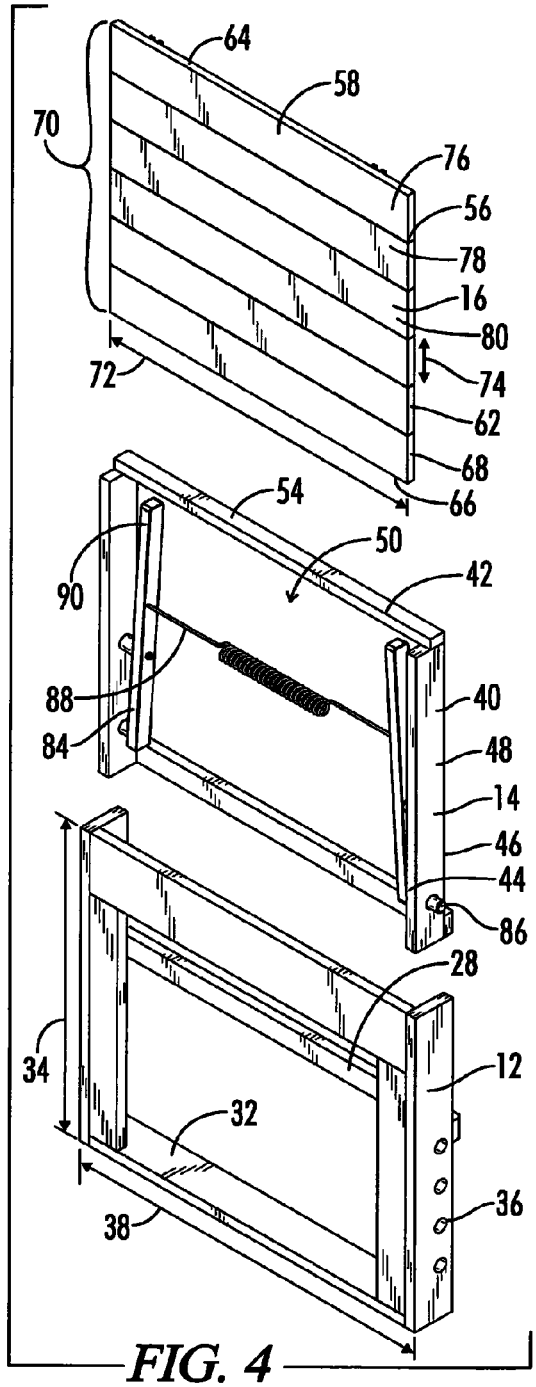
FIG. 4 is an exploded view of the present invention.

The present invention is a portable, inclined bed support 10 that is configured to be secured between the mattress and the bedframe or wall. The bed support 10, or alternatively bedrest, includes an exterior frame 12 to provide support and house the components of the support 10, an interior lift assembly 14 which is vertically extendible from within the exterior frame 12, and an adjustable ramp 16 which extends from the lift assembly 14. Each of these will be discussed in turn. It is envisioned that each of these elements can be composed of a plastic material, wood composite, or other material sufficiently capable of supporting a human.

The exterior frame 12 is configured to be inserted between the mattress and the wall or bedframe with the longitudinal axis 38 of the frame 12 running along the length of top of the bed. In this manner, the exterior frame 12 is secured by the frictional engagement of the mattress against the frame 12 and supported vertically by the close proximity of the bedframe or wall. The height of the exterior frame is intended to be the height of most beds from the floor to the top of the mattress. As bed heights can vary, the exterior frame 12 can range from 25 inches to 40 inches from the base of the frame to the top of the frame. It is intended that when the ramp 16 is retracted within the exterior frame 12, the bed support 10 is substantially concealed from view.

The exterior frame 12 is a parallelepiped frame structure having a base 18, a front 20, a back 22, a left and right side 24 which are mirrors of one another, and an open top area 26. The interior of the frame 12 is open and configured to house the ramp 16 and lift assembly 14. The front 20 and back 22 may likewise be partially open, as shown in the drawings, or enclosed. The front 20 and back 22 faces as shown have horizontal rails 28 running from one side 24 to the other parallel to the ground. These rails 28 assist in maintaining the ramp 16 within the exterior frame 12 and support the lift assembly 14. In one embodiment, the sides 24 include a series of apertures 30 open from the interior 32 to the exterior of the sides 24. The series of apertures 30 are positioned vertically in a straight line along the vertical axis 34 of the support 10. These apertures 30 serve as locking ports 36 for the lift assembly 14.

The top 26 of the frame 12 is open, allowing the lift assembly 14 and ramp 16 to be lifted vertically from the interior 32 of the frame 12. The lift assembly 14 includes a frame structure 40 positioned proximate to the exterior frame 12 and the locking assembly 50. In the preferred embodiment, the frame structure 40 is positioned beside the interior 32 of the frame 12, abutting the frame 12. The frame structure 40 has a top brace 42, a front 44, a back 46, a left and right side 48 which are mirrors of one another. The interior of the frame structure 40 is open and configured to house the locking assembly 50 that engages the locking ports 36 of the frame 12. The front 44 and back 46 may likewise be partially open, as shown in the drawings, or enclosed. The front 44 and back 46 faces as shown have horizontal rails 28 running from one side 48 to the other parallel to the ground. These rails 28 assist in maintaining the ramp 16 within the exterior frame 12 and support the lift assembly 14.

The locking assembly 50 is configured to engage the locking ports 36 when the lift assembly 14 is in a deployed position 82. The locking assembly 50 is envisioned in two embodiments. As shown in the drawings, the locking assembly 50 is composed of two locking arms or locking members 84 secured at the middle of the arms 84 proximate to the sides 48 of the lift assembly 14 and extending along the vertical axis 34 of the frame, each of the locking arms 84 having a locking rods 86 secured to one end of the locking arm 84 with a biasing spring 88 connected to the opposite top end 90 of the locking arm 84. The biasing spring 88 biases the top end 90 of the arms 84 together.

In another embodiment of the invention shown in FIGS. 12-17, the locking assembly 50 is enclosed in a fully enclosed frame 12 and composed of a grooved member 104 having a series of locking grooves and secured to the interior faces of the sides 24 of the frame 12 and an locking member 106 secured to the exterior sides 48 of the lift assembly 14 which face the interior of the frame. The series of grooves 110 function as a series of locking ports for the lift assembly lock into. At one end of the locking member 106, as series of teeth 110 are oriented towards the grooved member 104 for engagement during deployment of the lift assembly 14. The locking member 106 is connected to an engaging knob 108, located at the top of the lift assembly at the opposite end of the locking member 106 from the series of locking teeth 110, which can bias the locking member 106 to an unengaged position (shown in FIG. 15) separated from the grooved member 104 when the knob is biased upwards. The lift assembly can then be positioned while the locking member is unengaged. To reengage the locking member 106, the knob 108 is then depressed, moving the locking member 106 into an engaged position (shown in FIG. 16) with the teeth 110 of the locking member 106 directly within the grooves of the grooved member 104.

The ramp 16 is a substantially planar structure in its undeployed state 60 that is configured to flex and bend along joints 56 positioned at varying lengths along the ramp face 58. The ramp 16 has a front face 58, a back 62, a top 64, a bottom 66, and a left and right side 68 that are mirror images of one another. The ramp 16 is composed of a series of boards 70 connected by hinge joints 56 connected to the boards 70 on the back 62. The boards 70 are identical in length 72, extending the length of the longitudinal axis 38 of the lift assembly 14, but the boards 70 can vary in width 74. As shown in the figures, the first board 76 may have a shorter width 74 than the second board 78, while the third board 80 may have the same width 74 as the first board 76. In this manner, the width 74 of the boards 70 may alternate between short and long.

The lift assembly 14 is configured to be moved vertically along the vertical axis 34 of the frame 12. The lift assembly 14, at its undeployed position 52, is situated with the base of the sides 48 proximate the base 18 of the frame 12. The top brace 42 is positioned proximate to the top 26 of the frame 12, with the top face 54 of the brace 42 above the top 26 of the frame 12. To move the lift assembly 14 to a deployed position 82, the top brace 42 is slid along the vertical axis 34 of the frame. As the lift assembly 14 moves, the spring 88 biases the locking arm 84 outward at the ends, thus pushing the locking rods 86 into the locking port 36 apertures. In this manner, the lift assembly 14 is locked into a deployed position 82. As there are multiple locking ports 36 along the frame 12, the lift assembly can be deployed in multiple positions. In the deployed position, the top brace 42 is positioned at varying distances 92 distally from the top 26 of the frame 12.

Once the lift assembly is deployed 82, the ramp 16 is then moved from the undeployed position 94, stored in a flat, planar arrangement within the frame 12 and parallel to the vertical axis 34 of the frame, to a deployed position 96, with the ramp 16 being moved outside of the frame 12 with the one of the series of boards 70 positioned proximate to the top brace 42, a number of boards 70 positioned in front 20 of the frame 12, and some number of boards 70 positioned below the top brace 42 proximate to the lift assembly 14. In this manner, the ramp is deployed to extend outward from the frame 12 to form an angled ramp to support a user. As the ramp 16 can be deployed with differing boards 70 proximate to the top brace 42, the angle 98 created by the ramp 16 being deployed 96 is different based upon the number of boards in front of the frame 12. Likewise, the angle 98 is further modified by the height of the top brace 42 of the lift assembly. In this manner, the user can modify the angle 98 of the support 10. Further, the number of boards 70 deployed can be selected by the user to modify the area of the support beneath the user.

Figure 5:
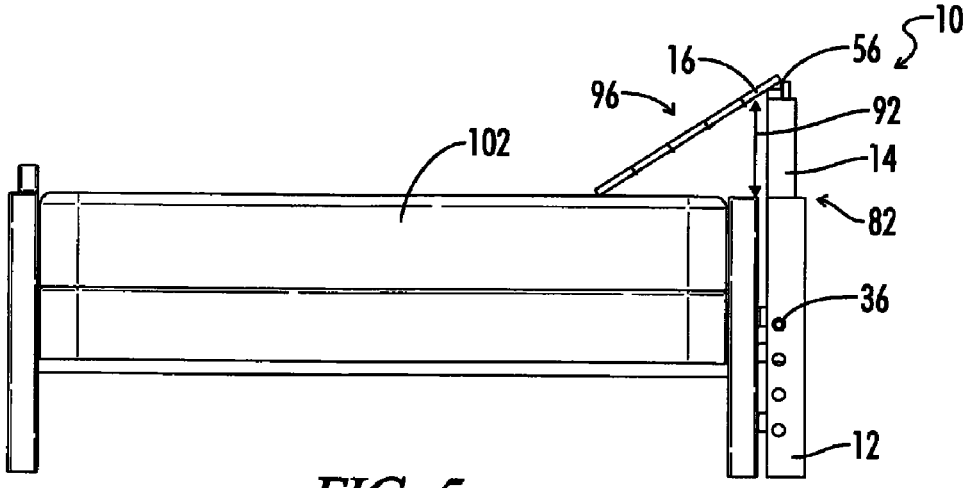
FIG. 5 is right side elevational view of the present invention with the lift assembly and ramp in a deployed state.
Figure 6:
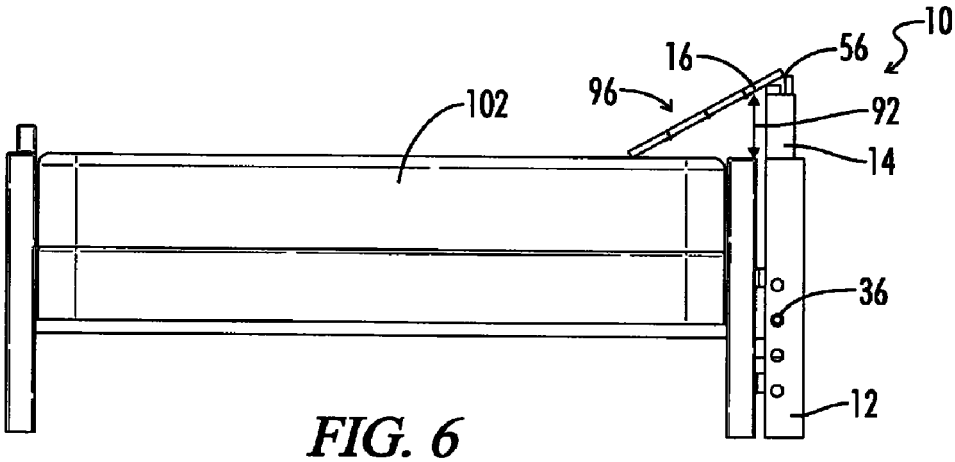
FIG. 6 is right side elevational view of the present invention with the lift assembly and ramp in another deployed state.
Figure 7:
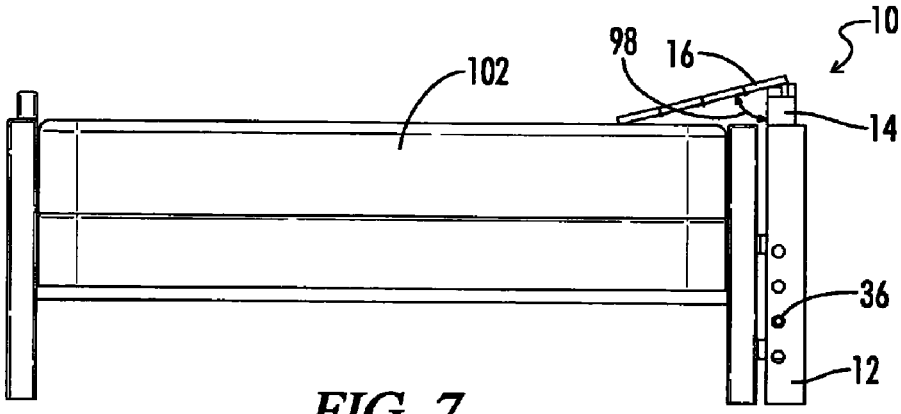
FIG. 7 is right side elevational view of the present invention with the lift assembly in another deployed state.
Figure 8:
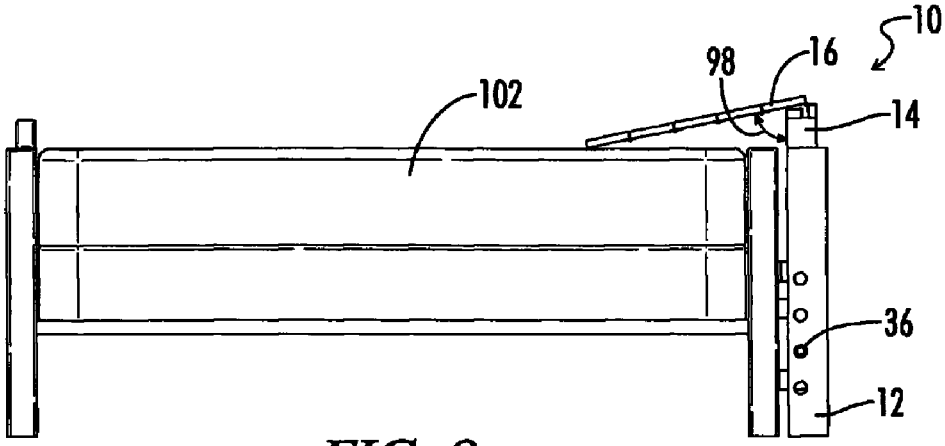
FIG. 8 is right side elevational view of the present invention with the lift assembly and ramp in a deployed state.

As illustrated in FIGS. 5-10, the lift assembly 14 can be raised to differing deployed positions and the ramp 16 can be deployed at different angles. In FIG. 5, the lift assembly 14 has been moved along the vertical axis of the frame 12 to engage the uppermost locking port 36 and the ramp 16 has been deployed with five boards 70 extended at angle 98 from the lift assembly and at an angle 100 from the mattress. In FIG. 6, the lift assembly 14 has been moved along the vertical axis of the frame 12 from a first deployed position to engage the second from the top locking port 36 to a second deployed position and the ramp 16 has been deployed with four boards 70 extended at angle 98 from the lift assembly and at an angle 100 from the mattress. In contrast to FIG. 6, FIG. 7 shows the modification of the lift assembly 14, which has been moved along the vertical axis of the frame 12 to engage the second from the bottom locking port 36, but the ramp 16 remains has been deployed with four boards 70 extended at angle 98 from the lift assembly and at an angle 100 from the mattress. As depicted in the drawings, in this manner, the movement of the lift assembly modifies the slope of the ramp 16 while the length of the ramp remains the same. FIG. 8 further shows this contrast when compared to FIG. 5. In FIG. 8, the lift assembly 14 has been moved along the vertical axis of the frame 12 to engage the lowest locking port 36, while the ramp 16 remains deployed with five boards 70 extended at angle 98 from the lift assembly and at an angle 100 from the mattress 102.

Figure 9:
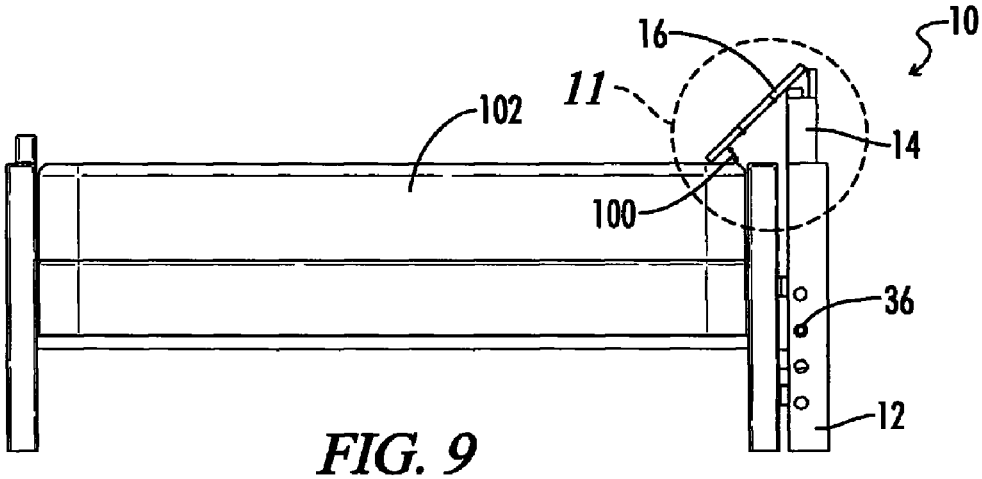
FIG. 9 is right side elevational view of the present invention with the lift assembly and ramp in another deployed state.
Figure 10:
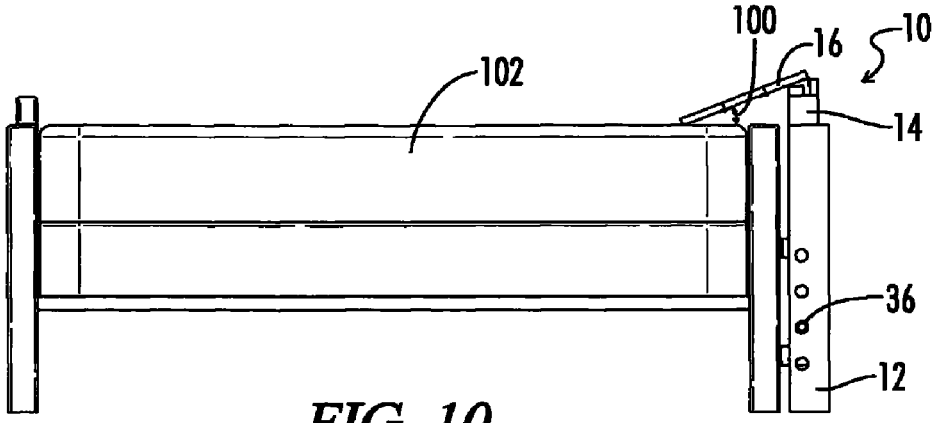
FIG. 10 is right side elevational view of the present invention with the lift assembly in another deployed state.
Figure 11:
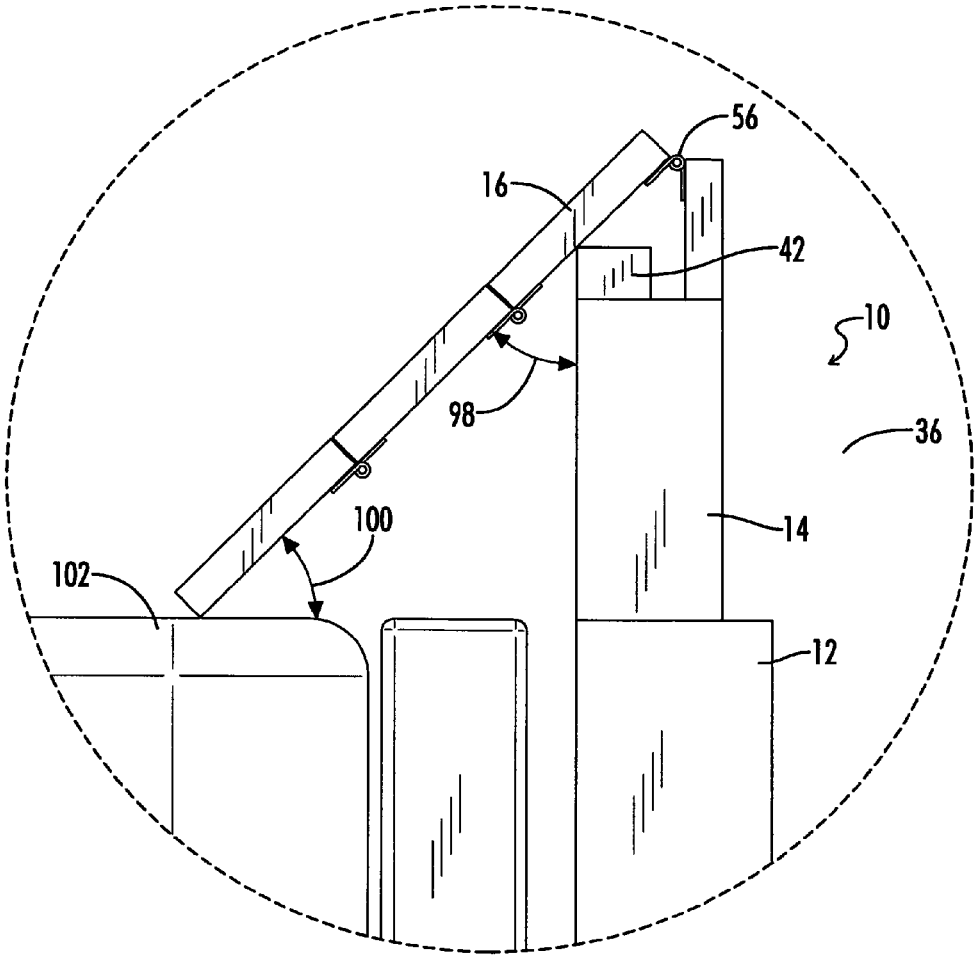
FIG. 11 is close up view of the lift assembly and ramp as deployed in FIG. 9.
Figure 12:
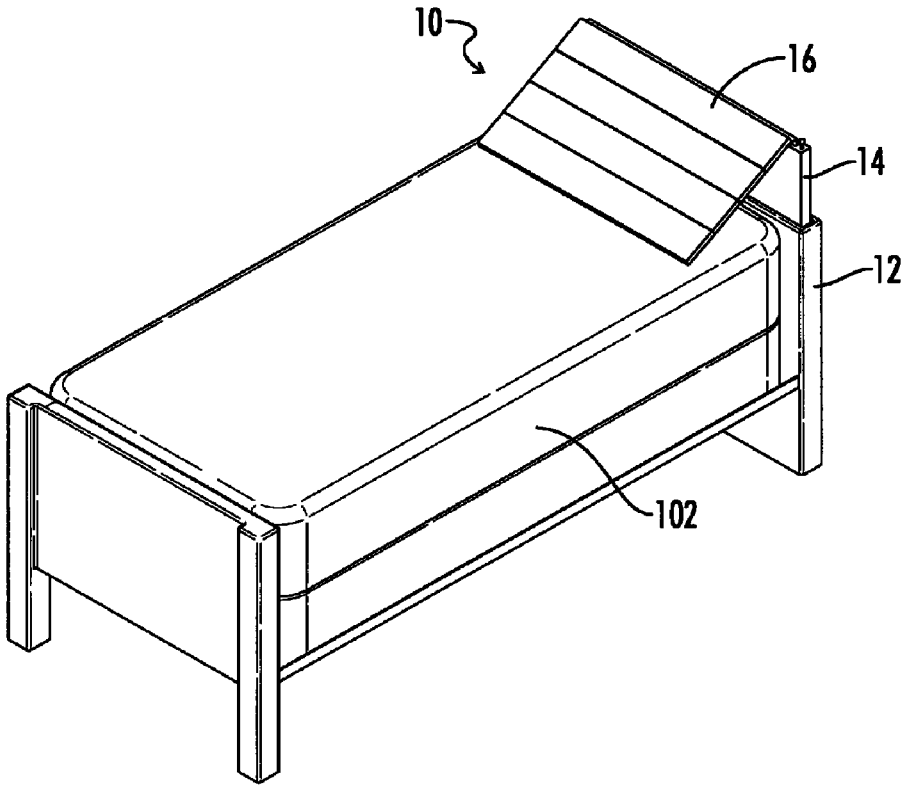
FIG. 12 is a perspective view of another embodiment of the invention, shown without a headboard for the bed.
Figure 13:
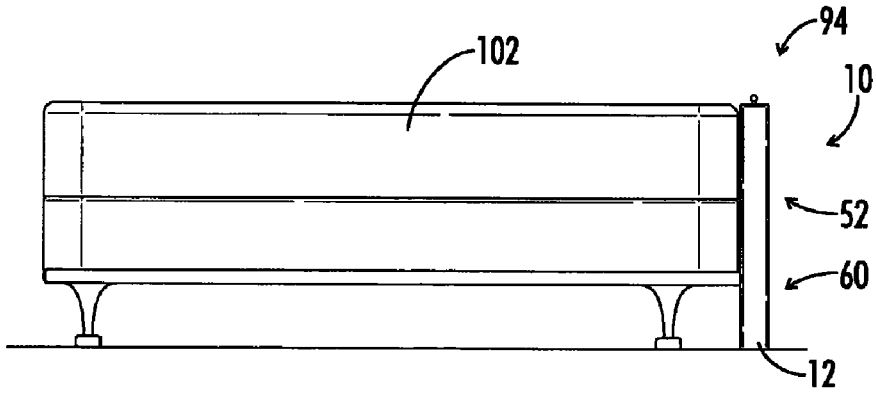
FIG. 13 is a right side elevational view of the same in its undeployed state.
Figure 14:
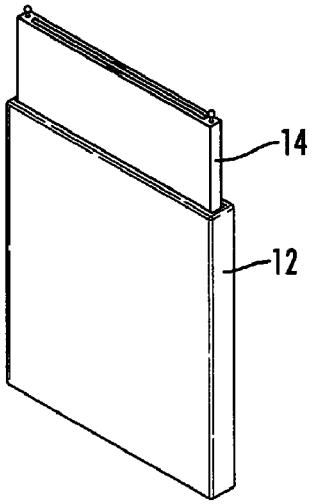
FIG. 14 is a perspective view of the same in its undeployed state.
Figure 15:
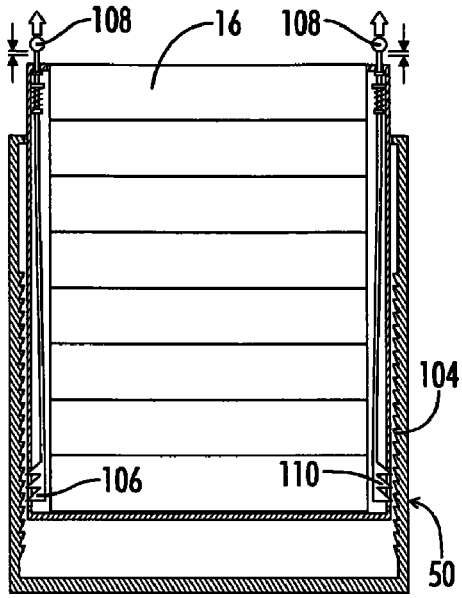
FIG. 15 is a cross-sectional view of the present invention showing the mechanism for deployment in a retracted position.
Figure 16:
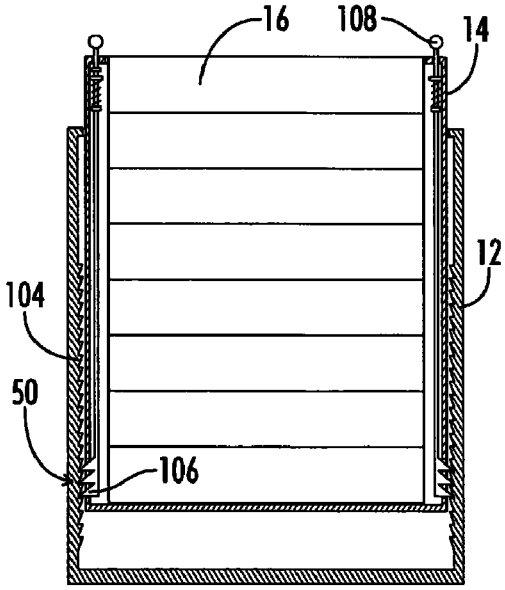
FIG. 16 is a cross-sectional view of the present invention showing the mechanism for deployment in an engaged position.
Figure 17:
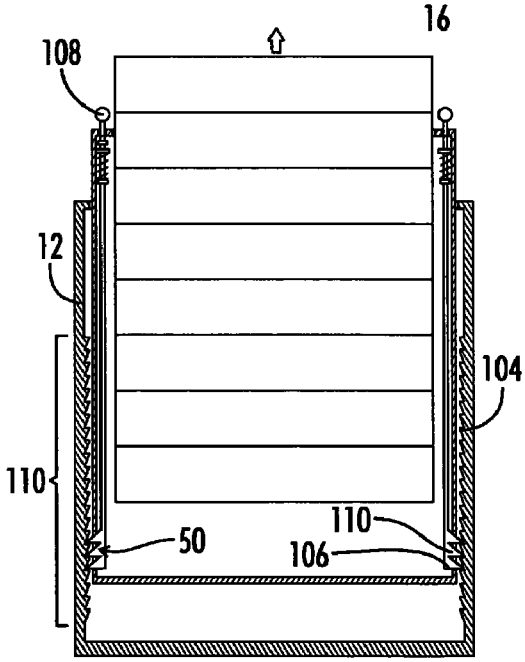
FIG. 17 is a cross-sectional view of the present invention showing the mechanism for deployment in an engaged position and the ramp being deployed.
Figure 18:
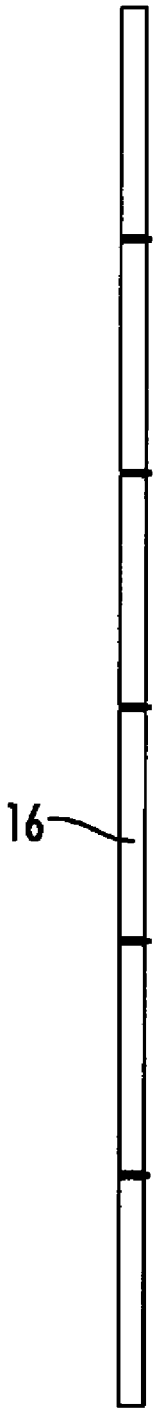
FIG. 18 is a left side view of the ramp.
Figure 19:
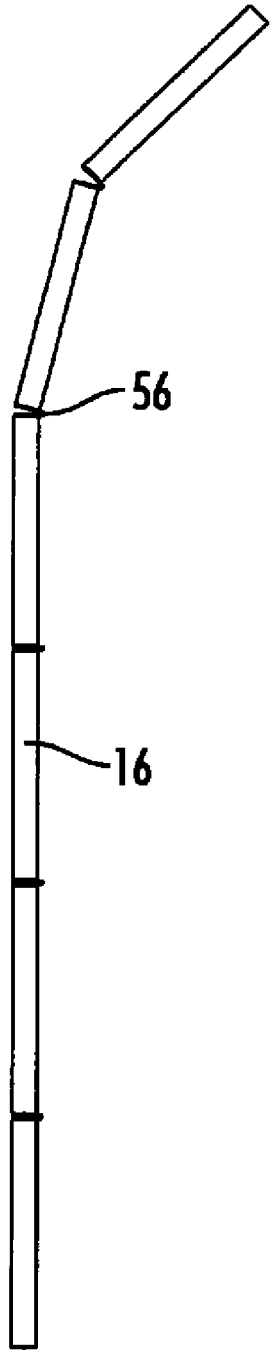
FIG. 19 is a left side view of the ramp.

The ramp 16 can likewise be modified alone with the lift assembly 14 remaining static. As shown in FIG. 9, the lift assembly 14 has been moved along the vertical axis of the frame 12 to engage the second from the top locking port 36 as also shown in FIG. 6. However, in contrast to FIG. 6, the ramp 16 has been deployed with three boards 70 extended at, angle 98 from the lift assembly and at an angle 100 from the mattress. The movement of the ramp from a first deployed position as shown in FIG. 9 to a second deployed position as shown in FIG. 6 modifies the slope of the ramp 16 along with the length of the ramp. In FIG. 10, the lift assembly 14 has been moved along the vertical axis of the frame 12 to engage the second lowest locking port 36, while the ramp 16 remains deployed with three boards 70 extended at angle 98 from the lift assembly and at an angle 100 from the mattress.

A sheet, blanket, cushion or other flexible material can be positioned on top of the ramp to soften the ramp.

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A bed rest providing body support for a bed having a vertical axis and a mattress, the bed rest comprising:

an exterior frame configured to fit proximate to the mattress and extending along a vertical axis parallel to the vertical axis of the bed, said exterior frame having a grooved member having a series of locking ports extending along said vertical axis;

a lift assembly having a top brace and proximate to said exterior frame, said lift assembly having a locking assembly comprising:

at least one locking member connected to said lift assembly, said locking member connected to a biasing knob, whereby said biasing knob motivates said locking member to engage said at least one grooved member thereby securing said lift assembly into a deployed position, said lift assembly configured to move along said vertical axis of said exterior frame from an undeployed position with said top brace proximate to said frame to said deployed position with said top brace positioned distally from said frame and held in said deployed position by said locking member engaging said one of said series of locking ports; and an adjustable ramp configured to extend from said lift assembly, said ramp assembly comprising a multitude of planks having varying widths and hingably connected to each other and configured to move from an undeployed position parallel to said vertical axis of said frame to a deployed position with at least one of said multitude of planks proximate to said top brace of said lift assembly and at least one of said multitude of planks deployed at angle to the mattress in front of said lift assembly.

2. The bed rest of claim 1, said lift assembly further configured to move from said undeployed position with said top brace proximate to said frame to a first deployed position with said top brace positioned distally from said frame to a second deployed position with said top brace positioned more distally from said frame than said first deployed position.

3. The bed rest of claim 1, said adjustable ramp further configured to move from said undeployed position to a first deployed position with at least two of said multitude of planks deployed at angle to the mattress to a second deployed position with at least three of said multiple planks deployed at an angle to the mattress different from said angle of said first deployed position.

4. The bed rest of claim 2, said adjustable ramp further configured to move from said undeployed position to a first deployed position with at least two of said multitude of planks deployed at angle to the mattress to a second deployed position with at least three of said multiple planks deployed at an angle to the mattress different from said angle of said first deployed position.

5. The support of claim 1, said at least one locking member further comprising a series of locking teeth configured to engage said series of locking ports.

6. A bed rest providing body support for a bed having a vertical axis and a mattress, the bed rest comprising:

an exterior frame configured to fit proximate to the mattress and extending along a vertical axis parallel to the vertical axis of the bed, said exterior frame having a series of locking grooves extending along said vertical axis;

a lift assembly having a top brace and proximate to said exterior frame, said lift assembly having a locking assembly configured to engage one of said series of locking grooves thereby securing said lift assembly into a deployed position; and an adjustable ramp configured to extend from said lift assembly, said ramp assembly comprising a multitude of planks having varying widths and hingably connected to each other and configured to move from an undeployed position parallel to said vertical axis of said frame to a deployed position with at least one of said multitude of planks proximate to said top brace of said lift assembly and at least one of said multitude of planks deployed at angle to the mattress in front of said lift assembly.

7. The support of claim 6, said lift assembly further comprising a locking member connected to said lift assembly and having an engaging knob configured to bias said locking member, whereby said locking member is configured to engage said series of locking grooves thereby securing said lift assembly into said deployed position.

8. The support of claim 6, said lift assembly further configured to move along said vertical axis of said exterior frame from an undeployed position with said top brace proximate to said frame to said deployed position with said top brace positioned distally from said frame and held in said deployed position by said locking member engaging said one of said series of locking grooves.

9. The support of claim 8, said locking member further comprising a series of locking teeth configured to engage said series of locking grooves.

10. The locking assembly of claim 9, said one locking member connected to said engaging knob at an opposite end of said at least one locking arm from said series of locking teeth, whereby said engaging knob is configured to motivate said locking member from an unengaged position with said series of locking teeth separated from said series of locking grooves to an engaged position with said series of locking teeth engaged with said series of locking grooves, thereby securing said lift assembly into said deployed position.

11. A bed rest providing body support for a bed having a vertical axis and a mattress, the bed rest comprising:

an exterior frame configured to fit proximate to the mattress and extending along a vertical axis parallel to the vertical axis of the bed, said exterior frame having at least one locking groove along said vertical axis;

a lift assembly having a top brace and proximate to said exterior frame, said lift assembly having a locking assembly configured to engage said at least one locking groove thereby securing said lift assembly into a deployed position; and an adjustable ramp configured to extend from said lift assembly from an undeployed position to a deployed position at angle to the mattress.

12. The support of claim 11, said lift assembly further comprising at least one locking member connected to said lift assembly and having an engaging knob configured to bias said locking member, whereby said locking member is configured to engage said at least one locking groove thereby securing said lift assembly into said deployed position.

13. The support of claim 12, said lift assembly further configured to move along said vertical axis of said exterior frame from an undeployed position with said top brace proximate to said frame to said deployed position with said top brace positioned distally from said frame and held in said deployed position by said locking member engaging said at least one locking groove.

14. The support of claim 13, said locking member further comprising a series of locking teeth configured to engage said series of locking grooves.

15. The locking assembly of claim 14, said one locking member connected to said engaging knob at an opposite end of said at least one locking arm from said series of locking teeth, whereby said engaging knob is configured to motivate said locking member from an unengaged position with said series of locking teeth separated from said series of locking grooves to an engaged position with said series of locking teeth engaged with said series of locking grooves, thereby securing said lift assembly into said deployed position.

16. The adjustable ramp of claim 11, said ramp assembly comprising a multitude of planks having varying widths and hingably connected to each other.

17. The adjustable ramp of claim 16, said undeployed position parallel to said vertical axis of said frame.

18. The adjustable ramp of claim 16, said deployed position with at least one of said multitude of planks proximate to said top brace of said lift assembly and at least one of said multitude of planks deployed at angle to the mattress.

19. The bed rest of claim 11, said lift assembly further configured to move from said undeployed position with said top brace proximate to said frame to a first deployed position with said top brace positioned distally from said frame to a second deployed position with said top brace positioned more distally from said frame than said first deployed position.

20. The bed rest of claim 18, said adjustable ramp further configured to move from said undeployed position to a first deployed position with at least two of said multitude of planks deployed at angle to the mattress to a second deployed position with at least three of said multiple planks deployed at an angle to the mattress different from said angle of said first deployed position.

* * * * *